US006851138B1

(12) United States Patent
Wilson

(10) Patent No.: US 6,851,138 B1
(45) Date of Patent: Feb. 8, 2005

(54) HAMMOCK SYSTEM

(76) Inventor: Buzz B. Wilson, 19171 Road 220, Strathmore, CA (US) 93267

( * ) Notice: Subject to any disclaimer, the term of this patent is extended or adjusted under 35 U.S.C. 154(b) by 0 days.

(21) Appl. No.: 10/672,245

(22) Filed: Sep. 25, 2003

(51) Int. Cl.[7] ..... A45F 3/22

(52) U.S. Cl. ..... 5/120; 5/124; 5/125; 5/126; 5/127

(58) Field of Search ..... 5/120, 124–127, 5/129, 98.3, 103; 297/273

(56) References Cited

U.S. PATENT DOCUMENTS

| | | | | | |
|---|---|---|---|---|---|
| 287,078 | A | | 10/1883 | Amrock | |
| 816,340 | A | | 3/1906 | Knoernschild | |
| 909,102 | A | | 1/1909 | Maxwell | |
| 940,939 | A | | 11/1909 | Patterson | |
| 1,142,472 | A | | 6/1915 | White | |
| 1,257,984 | A | | 3/1918 | Drexler | |
| 1,346,689 | A | * | 7/1920 | Sisbower et al. | 5/124 |
| 1,406,737 | A | * | 2/1922 | Hoy | 5/124 |
| 1,747,493 | A | * | 2/1930 | Snook | 297/283.2 |
| 1,798,546 | A | | 3/1931 | Lillibridge | |
| 2,014,651 | A | * | 9/1935 | Johnson | 5/124 |
| 4,917,378 | A | | 4/1990 | Girecky et al. | 272/85 |
| 4,977,631 | A | | 12/1990 | Bretz | 5/118 |
| 5,095,563 | A | | 3/1992 | Miller | 5/101 |
| 5,240,021 | A | | 8/1993 | Snodgrass | 135/96 |
| 5,564,987 | A | * | 10/1996 | Ayrolles | 472/118 |
| 5,659,906 | A | | 8/1997 | Nickell et al. | 5/122 |
| 5,855,031 | A | | 1/1999 | Swift, Jr. | 5/93.1 |
| 5,957,780 | A | * | 9/1999 | Grazioli | 472/118 |
| D460,286 | S | | 7/2002 | Liu | D6/387 |
| D461,329 | S | | 8/2002 | Liu | D6/387 |

* cited by examiner

*Primary Examiner*—Michael Trettel

(57) ABSTRACT

A hammock system for allowing an individual to efficiently enter and exit the hammock in a safe manner. The hammock system includes a support frame, and a cradle frame having opposing ends pivotally attached to the support frame. The cradle frame has a middle section surrounded by two opposing side sections, wherein the side sections are at an angle with respect to the middle section forming a concave structure. A mattress is preferably positioned upon the cradle frame. A catch member may be attached to the support frame and removably connected to the cradle frame to retain the cradle frame in a sofa position.

20 Claims, 8 Drawing Sheets

HAMMOCK SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to hammock devices and more specifically it relates to a hammock system for allowing an individual to efficiently enter and exit the hammock in a safe manner.

2. Description of the Related Art

Hammocks have been in use for years. Typically, a hammock is comprised of a netting structure wherein the opposing ends thereof are attached to opposing structures. U.S. Pat. No. 816,340 teaches an exemplary hammock supported within a frame structure.

The individual entering the hammock must enter the hammock in a careful manner attempting to position their body immediately within the center portion of the hammock to avoid falling out of the hammock. However, this can be extremely difficult to accomplish for many individuals, particularly individuals of limited physical ability and overweight individuals.

While conventional hammocks may be suitable for the particular purpose to which they address, they are not as suitable for allowing an individual to efficiently enter and exit the hammock in a safe manner. Conventional hammocks are unsafe and difficult to exit and enter.

In these respects, the hammock system according to the present invention substantially departs from the conventional concepts and designs of the prior art, and in so doing provides an apparatus primarily developed for the purpose of allowing an individual to efficiently enter and exit the hammock in a safe manner.

BRIEF SUMMARY OF THE INVENTION

In view of the foregoing disadvantages inherent in the known types of hammocks now present in the prior art, the present invention provides a new hammock system construction wherein the same can be utilized for allowing an individual to efficiently enter and exit the hammock in a safe manner.

The general purpose of the present invention, which will be described subsequently in greater detail, is to provide a new hammock system that has many of the advantages of the hammocks mentioned heretofore and many novel features that result in a new hammock system which is not anticipated, rendered obvious, suggested, or even implied by any of the prior art hammocks, either alone or in any combination thereof.

To attain this, the present invention generally comprises a support frame, and a cradle frame having opposing ends pivotally attached to the support frame. The cradle frame has a middle section surrounded by two opposing side sections, wherein the side sections are at an angle with respect to the middle section forming a concave structure. A mattress is preferably positioned upon the cradle frame. A catch member may be attached to the support frame and removably connected to the cradle frame to retain the cradle frame in a sofa position.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a hammock system that will overcome the shortcomings of the prior art devices.

A second object is to provide a hammock system for allowing an individual to efficiently enter and exit the hammock in a safe manner.

Another object is to provide a hammock system that does not require significant physical effort to enter or exit compared to a conventional hammock.

An additional object is to provide a hammock system that is convertible between a hammock position and a sofa position.

A further object is to provide a hammock system that is comfortable and easy to utilize.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
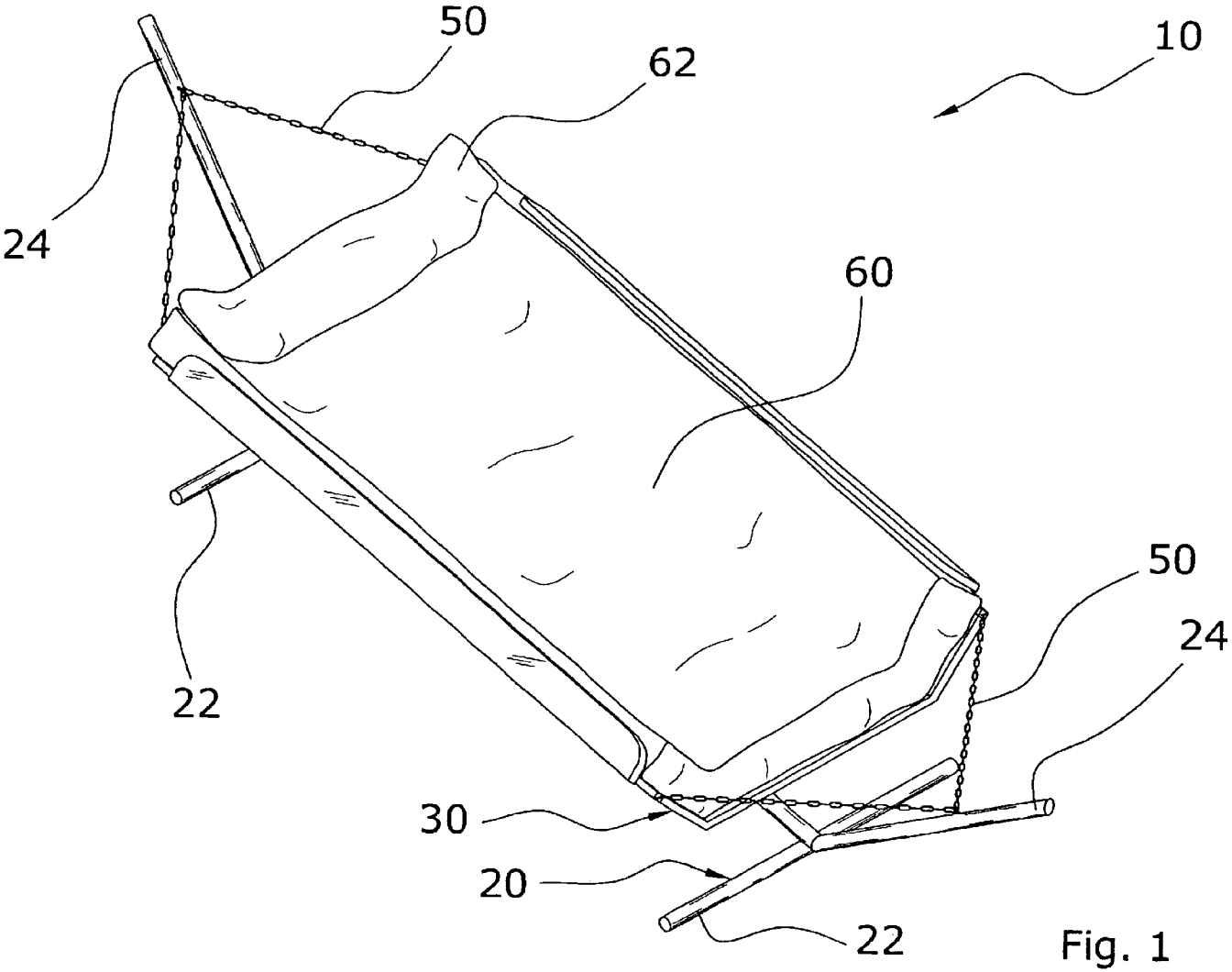
FIG. 1 is an upper perspective view of the present invention.

Turning now descriptively to the drawings, in which similar reference characters denote similar elements throughout the several views, FIGS. 1 through 8 illustrate a hammock system 10, which comprises a support frame 20, and a cradle frame 30 having opposing ends pivotally attached to the support frame 20. The cradle frame 30 has a middle section 31 surrounded by two opposing side sections 33, wherein the side sections 33 are at an angle with respect to the middle section 31 forming a concave structure. A mattress 60 is preferably positioned upon the cradle frame 30. A catch member 40 may be attached to the support frame 20 and removably connected to the cradle frame 30 to retain the cradle frame 30 in a sofa position.

B. Support Frame

The support frame 20 is comprised of a rigid structure capable of supporting the cradle frame 30, a mattress 60 and a person positioned upon the mattress 60 as best illustrated in FIGS. 3 through 7 of the drawings. The support frame 20 includes a plurality of legs 22, a center member extending between the legs 22 and a pair of poles 24 extending upwardly from the legs 22.

Figure 5:
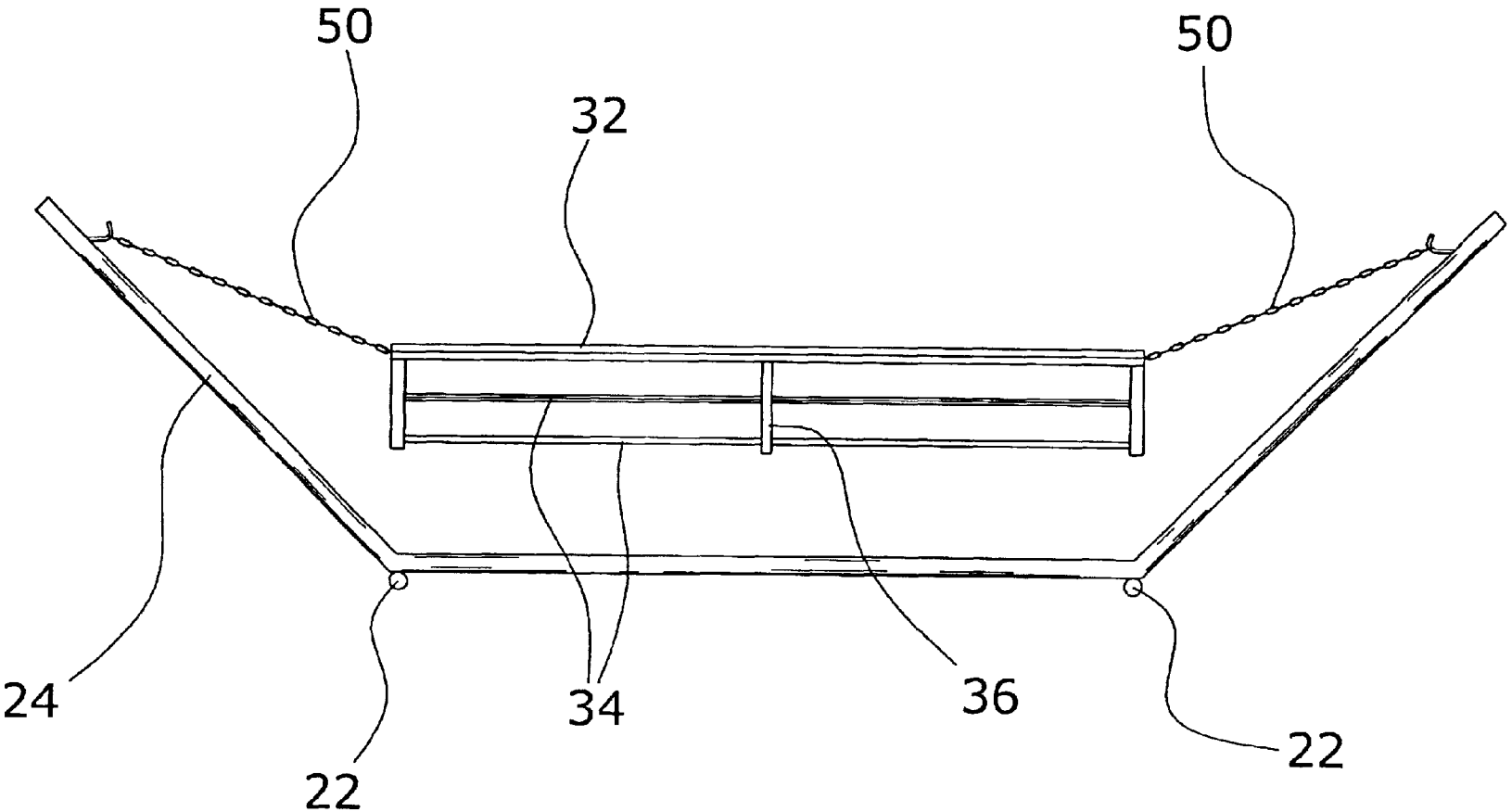
FIG. 5 is a side view of the present invention with the mattress removed.

The poles 24 preferably extend upwardly at an outward angle as best illustrated in FIG. 5 of the drawings. While FIGS. 1 through 8 illustrate an exemplary support frame 20, it can be appreciated that various other structures may be utilized to support the cradle frame 30.

C. Cradle Frame

The cradle frame 30 has opposing ends pivotally attached to the support frame 20 by a pair of flexible support members 50 as shown in FIGS. 1 through 5 of the drawings. The support members 50 may be comprised of rope, cable, chain or any other flexible structure. As shown in FIGS. 1 through 4 of the drawings, the support members 50 are preferably attached to the opposing sides of the ends of the cradle frame 30 and are tapered inwardly to attached to an upper portion of the poles 24.

Figure 3:
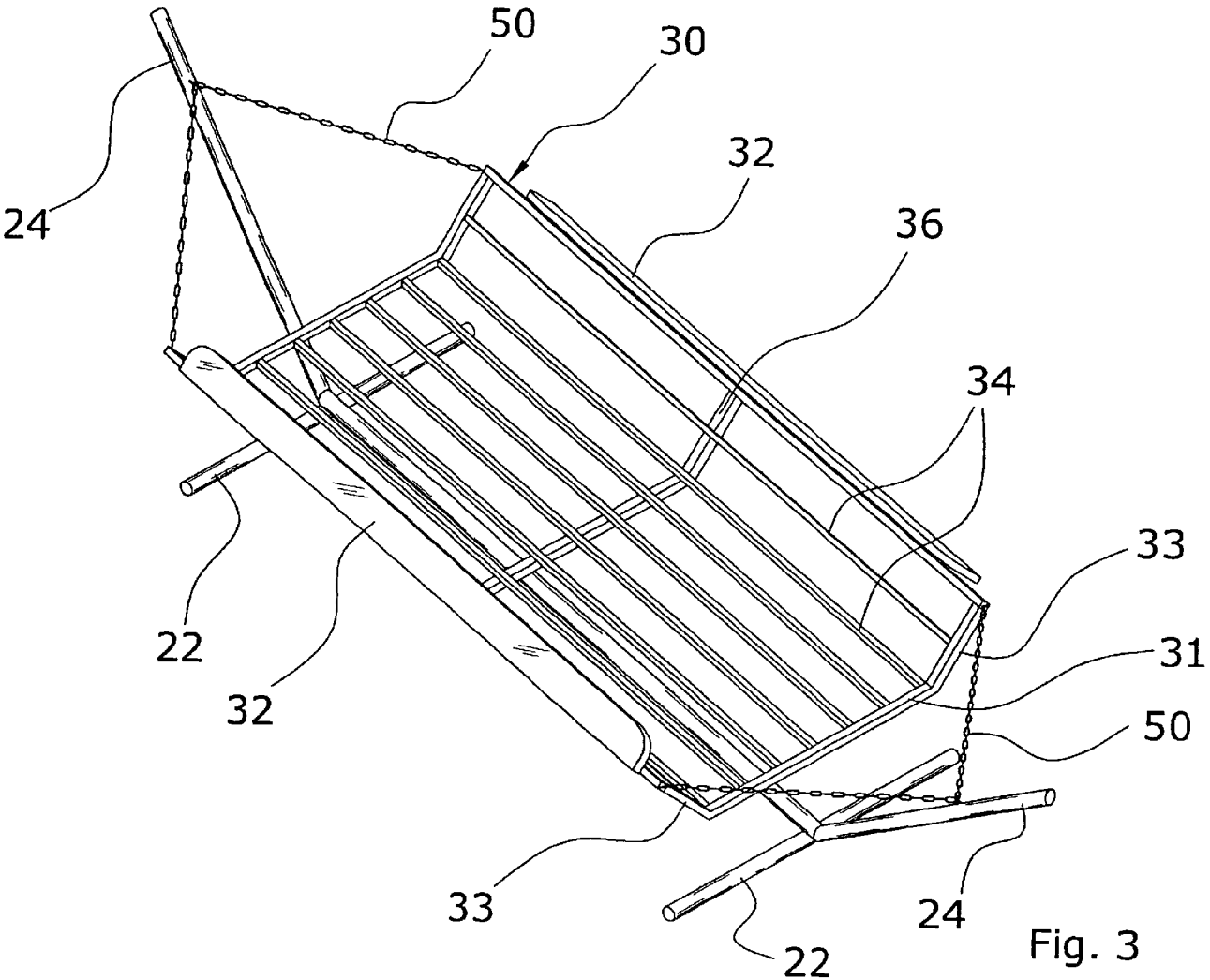
FIG. 3 is an upper perspective view of the present invention with the mattress removed.
Figure 4:
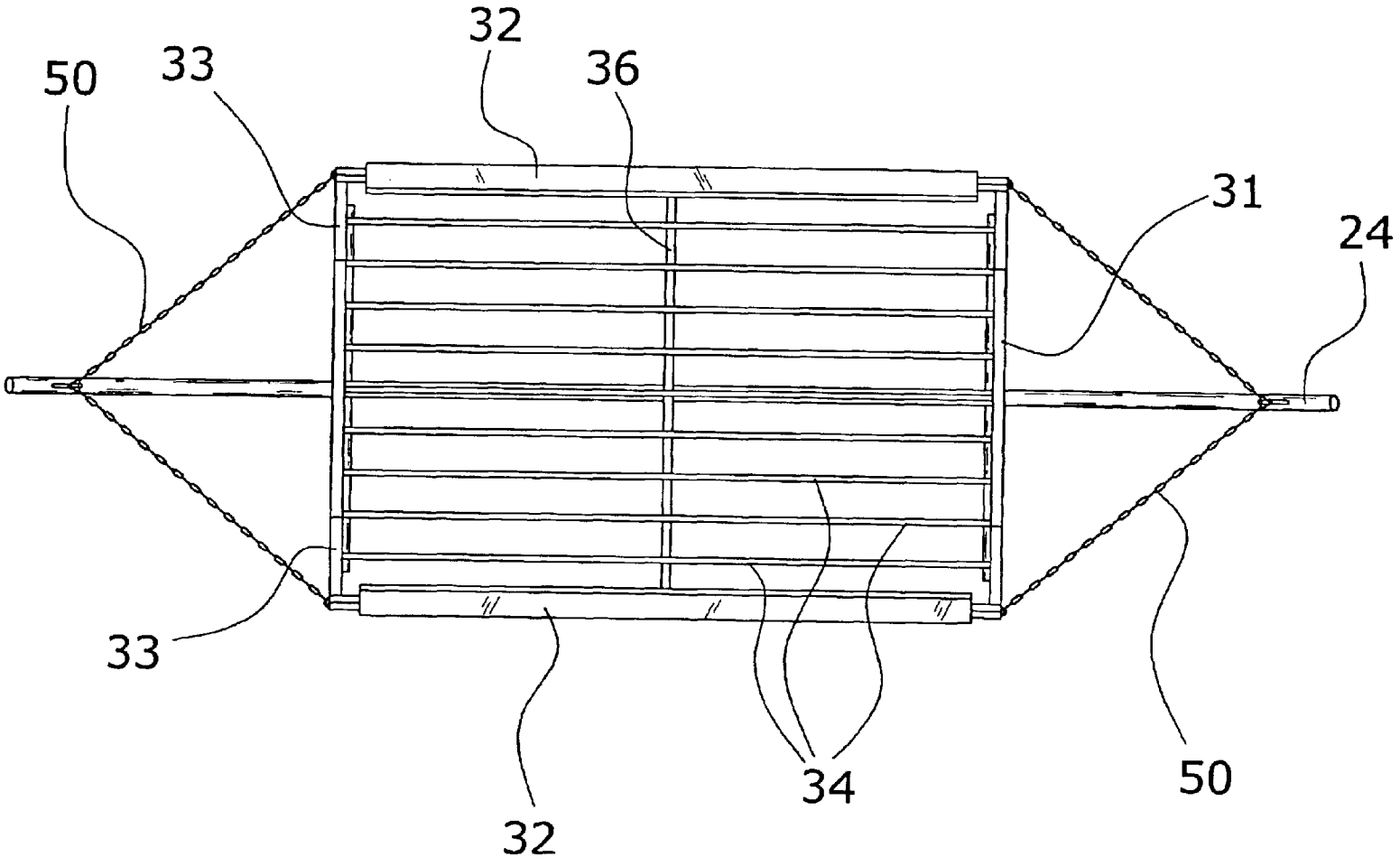
FIG. 4 is a top view of the present invention with the mattress removed.
Figure 6:
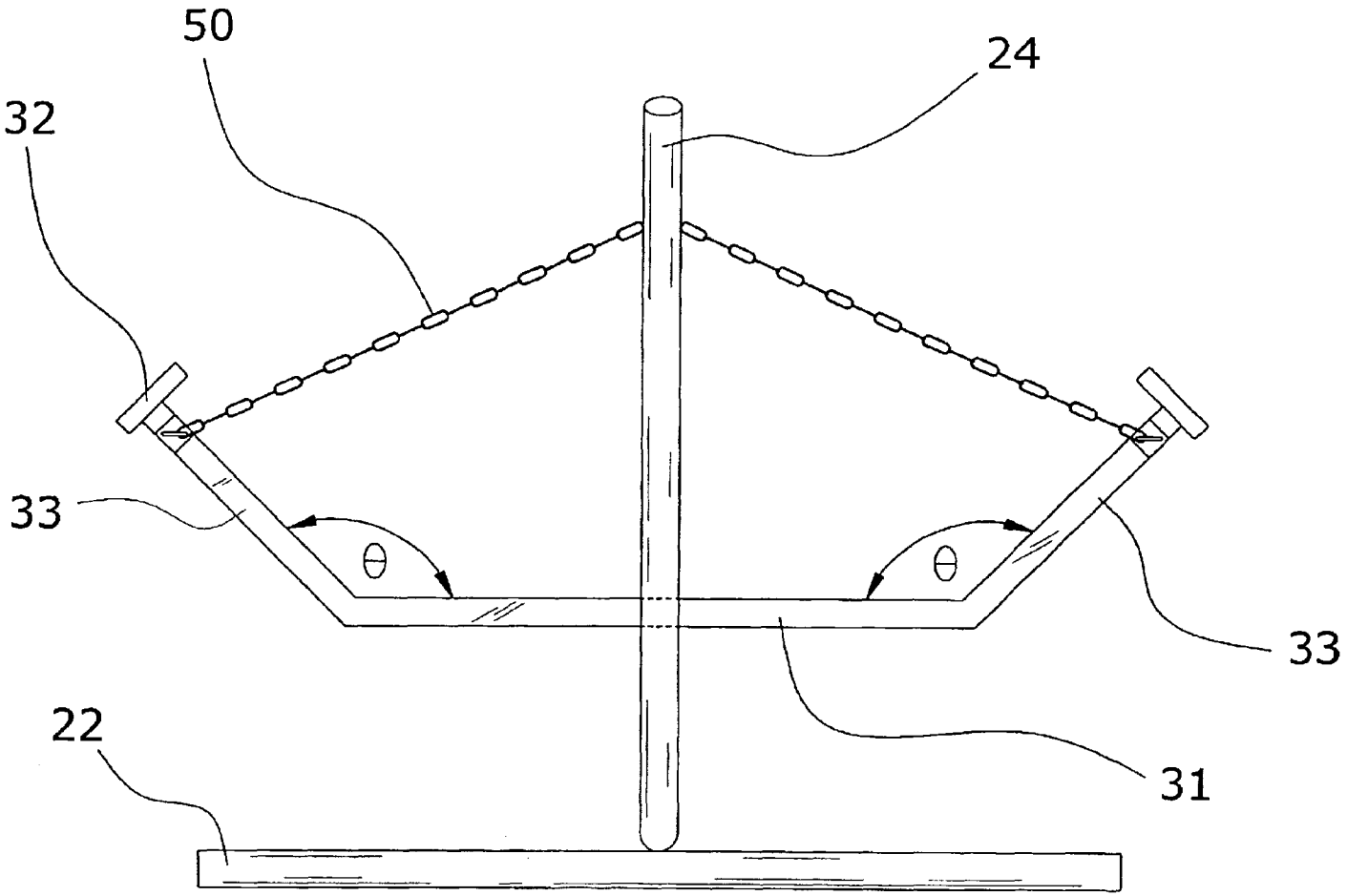
FIG. 6 is an end view of the present invention with the mattress removed.
Figure 7:
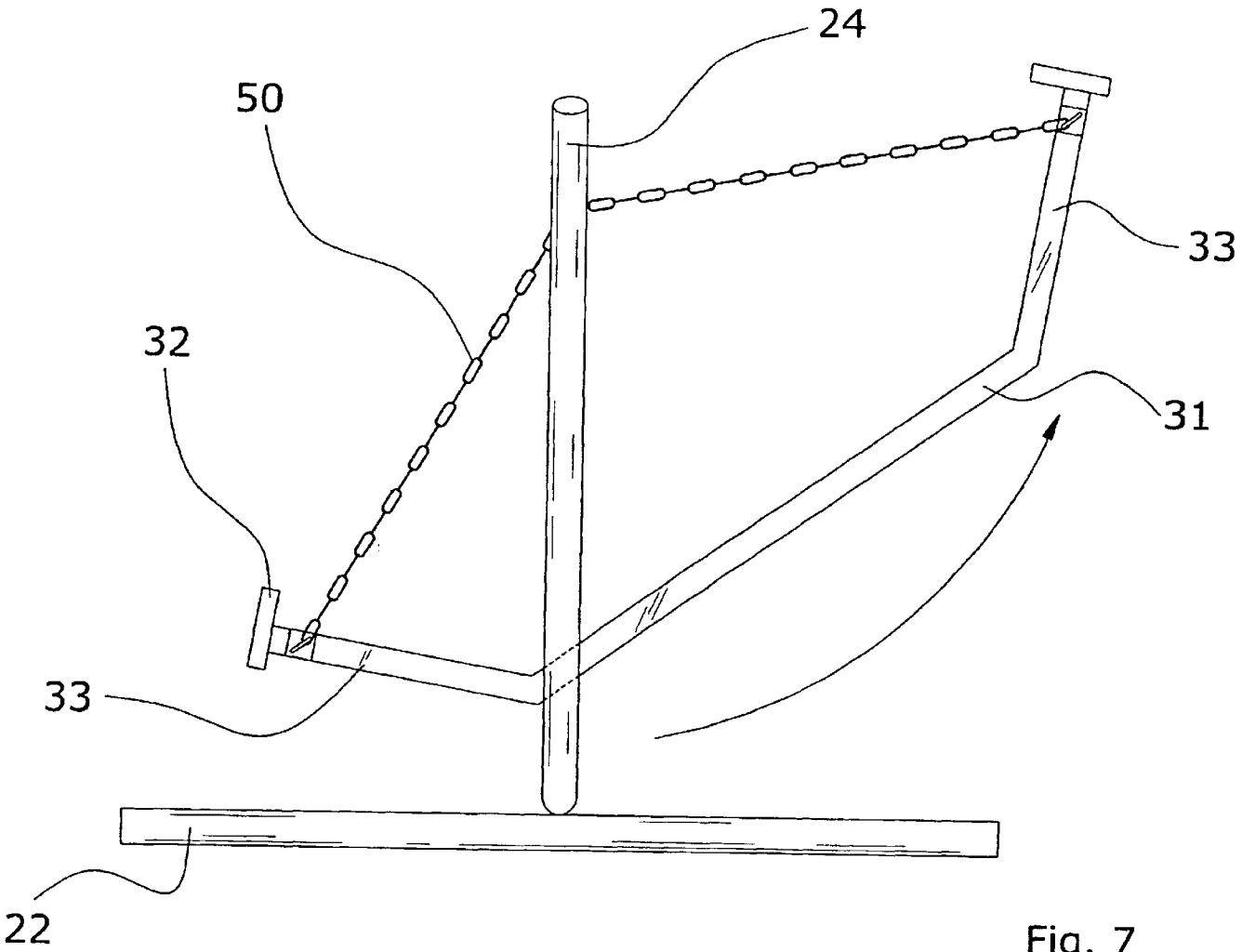
FIG. 7 is an end view of the present invention illustrating the entry or exit position of the cradle frame.

As best illustrated in FIGS. 3, 6 and 7 of the drawings, he cradle frame 30 has a middle section 31 surrounded by two opposing side sections 33. The side sections 33 are preferably at an angle θ with respect to the middle section 31 forming a concave structure as best illustrated in FIG. 6 of the drawings. The angle θ is preferably the same for both of the side sections 33, however the angle θ may differ. The angle θ is preferably approximately 45 degrees, however greater or less angles may be utilized for the angle θ.

The middle section 31 and the side sections 33 preferably have a substantially straight structure as shown in FIGS. 3, 6 and 7 of the drawings. The cradle frame 30 includes a plurality of rib members 34 and cross member 36 attached to the rib members 34 as illustrated in FIG. 3 of the drawings.

The cradle frame 30 includes a pair of opposing end members 32 extending from opposing sides of the cradle frame 30 as best illustrated in FIGS. 1 through 4 of the drawings. The end members 32 extend upwardly for receiving a mattress 60 between thereof.

Figure 2:
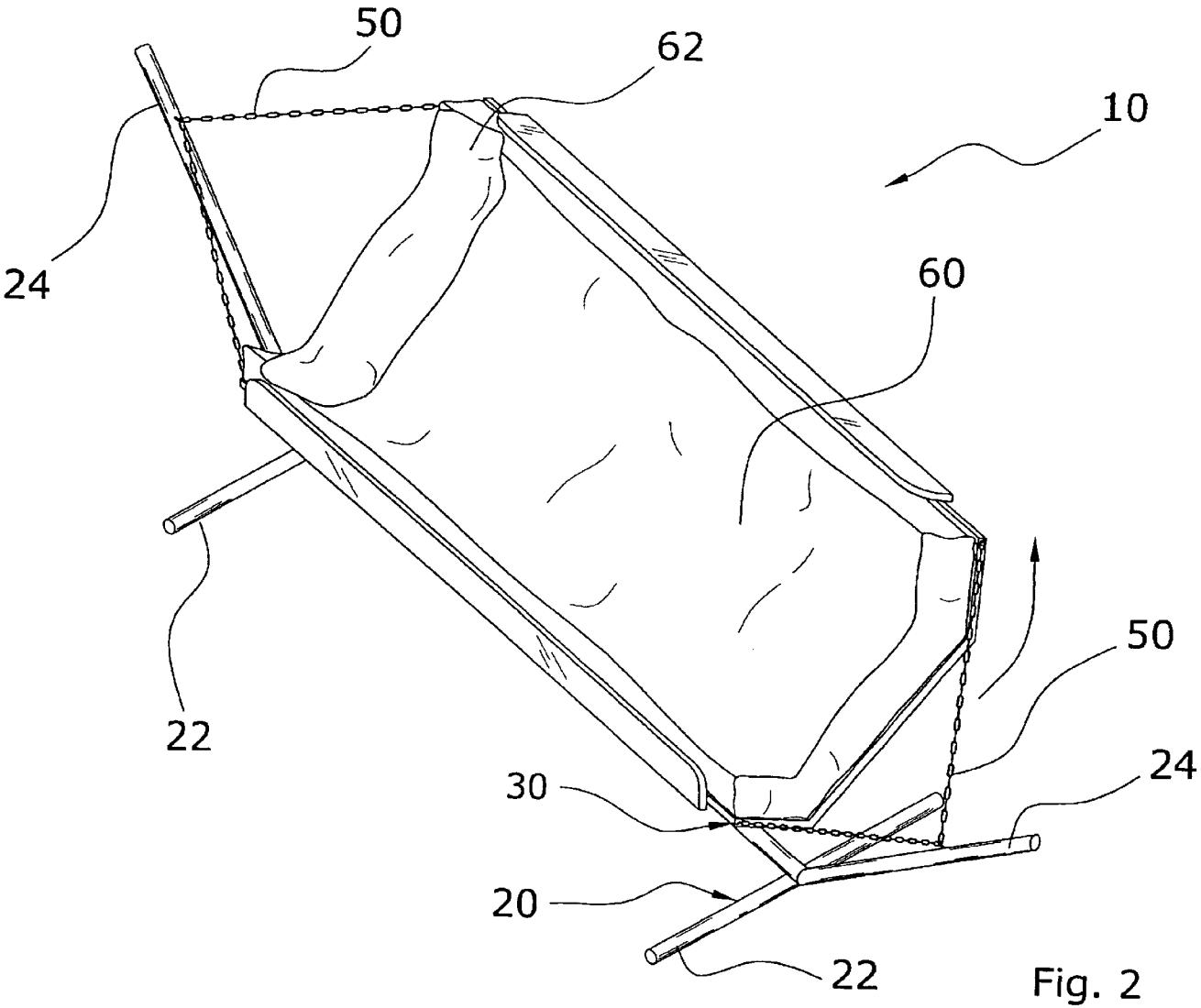
FIG. 2 is an upper perspective view of the present invention in a rotated position for entering or exiting.

A mattress 60 or similar structure is preferably positionable upon the cradle frame 30 for supporting an individual as shown in FIGS. 1 and 2 of the drawings. One or more pillows 62 may be positioned upon the mattress 60 as desired.

D. Catch Member

Figure 8:
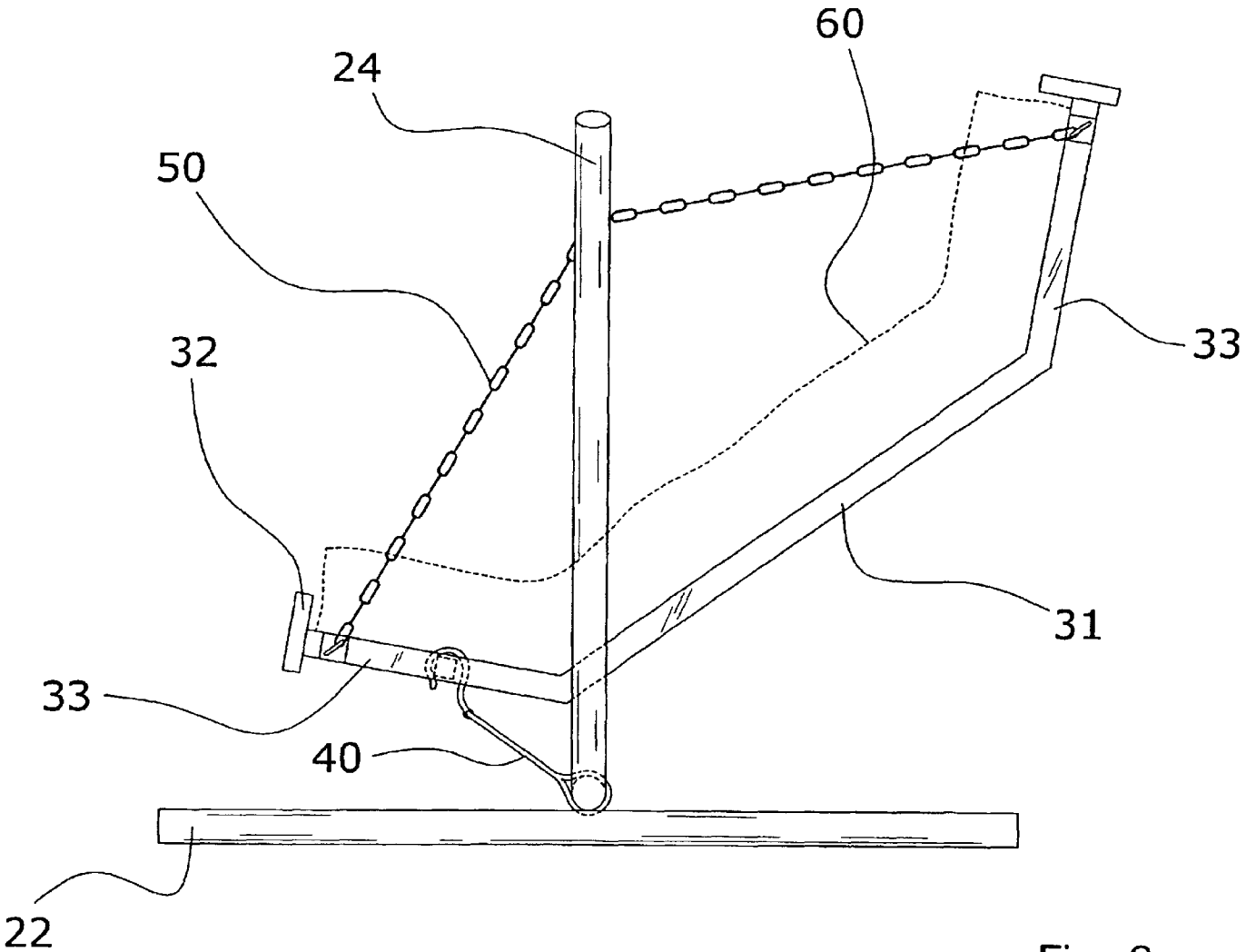
FIG. 8 is an end view of the present invention rotated and locked into a sofa position by a catch member.

A catch member 40 is attachable between the support frame 20 and the cradle frame 30 to retain the cradle frame 30 in a sofa position as shown in FIG. 8 of the drawings. The catch member 40 has a hooked end for selectively engaging the cradle frame 30, such as one of the rib members 34.

E. Operation of Invention—Hammock Position

When utilizing the present invention as a hammock (FIGS. 1 through 7), the user approaches one of the side sections 33 of the cradle frame 30. The user then pushes (or sits) upon the selected side section 33 thereby causing the cradle frame 30 to pivot within the support frame 20 as shown in FIG. 2 of the drawings. The downward force applied to the raised selected side section 33 causes the selected side section 33 to lower to a substantially horizontal state.

Once the cradle frame 30 is positioned in the entry position (FIGS. 2 and 7), the user then enters the cradle frame 30 and proceeds to the middle section 31. As the user approaches the middle section 31, the cradle frame 30 returns to its normal position as shown in FIGS. 1 and 6 of the drawings.

To exit the cradle frame 30, the user simply moves towards one of the side sections 33 thereby causing the selected side section 33 to lower (similar to entering). The user is then able to easily exit the cradle frame 30.

F. Operation of Invention—Sofa Position

When utilizing the present invention in the sofa position (FIG. 8), the user pivots the cradle frame 30 within the support frame 20 as shown in FIG. 8 of the drawings. The user then attaches the catch member 40 to the cradle frame 30 (e.g. a rib member 34). The user then releases the cradle frame 30 wherein the cradle frame 30 is retained in the sofa position where the user may freely sit and exit from the cradle frame 30 similar to a sofa as shown in FIG. 8 of the drawings without the cradle frame 30 moving significantly. To release the cradle frame 30 from the sofa position, the user merely releases the catch member 40 thereby releasing the cradle frame 30.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hammock system, comprising:

a support frame, wherein said support frame includes a plurality of legs and a pair of poles extending upwardly from said support frame at an outward angle, and wherein said poles extend upwardly at an outward angle; and a cradle frame having opposing ends pivotally attached to said poles, wherein said cradle frame has a middle section surrounded by two opposing side sections wherein said side sections are at an angle with respect to said middle section forming a concave structure, wherein said cradle frame is pivotally attached to said poles.

2. The hammock system of claim 1, wherein said cradle frame includes a pair of opposing end members extending from opposing sides of said cradle frame, wherein said end members extend upwardly for receiving a mattress within.

3. The hammock system of claim 1, wherein said angle between said middle section and said side sections is approximately forty-five degrees.

4. The hammock system of claim 3, wherein said middle section and said side sections have a straight structure.

5. The hammock system of claim 1, including a catch member attachable between said support frame and said cradle frame to retain said cradle frame in a sofa position.

6. The hammock system of claim 5, wherein said catch member has a hooked end for selectively engaging said cradle frame.

7. The hammock system of claim 1, wherein said cradle frame includes a plurality of rib members.

8. The hammock system of claim 7, wherein said cradle frame includes a cross member.

9. A hammock system, comprising:

a support frame, wherein said support frame includes a plurality of legs and a pair of poles extending upwardly from said support frame at an outward angle; and a cradle frame having opposing ends pivotally attached to said poles by a pair of flexible support members, wherein said cradle frame has a middle section surrounded by two opposing side sections wherein said side sections are at an angle with respect to said middle section forming a concave structure.

10. The hammock system of claim 9, wherein said cradle frame includes a pair of opposing end members extending from opposing sides of said cradle frame, wherein said end members extend upwardly for receiving a mattress within.

11. The hammock system of claim 9, wherein said angle between said middle section and said side sections, is approximately forty-five degrees.

12. The hammock system of claim 11, wherein said middle section and said side sections have a straight structure.

13. The hammock system of claim 9, including a catch member attachable between said support frame and said cradle frame to retain said cradle frame in a sofa position.

14. The hammock system of claim 13, wherein said catch member has a hooked end for selectively engaging said cradle frame.

15. The hammock system of claim 9, wherein said cradle frame includes a plurality of rib members.

16. The hammock system of claim 15, wherein said cradle frame includes a cross member.

17. A hammock system, comprising:

a support frame;

a cradle frame having opposing ends pivotally attached to said support frame, wherein said cradle frame has a middle section surrounded by two opposing side sections wherein said side sections are at an angle with respect to said middle section forming a concave structure; and a catch member attachable between said support frame and said cradle frame to retain said cradle frame in a sofa position.

18. The hammock system of claim 17, wherein said catch member has a hooked end for selectively engaging said cradle frame.

19. The hammock system of claim 17, wherein said support frame includes a plurality of legs and a pair of poles extending upwardly from said support frame, wherein said cradle frame is pivotally attached to said poles and wherein said poles extend upwardly at an outward angle.

20. The hammock system of claim 17, wherein said angle between said middle section and said side sections is approximately forty-five degrees.

* * * * *